United States Patent [19]

Kanno et al.

[11] Patent Number: 4,791,866

[45] Date of Patent: Dec. 20, 1988

[54] SPEED CONTROL METHOD FOR PRINTING PRESS AND PRINTING PRESS PRACTICING THE METHOD

[75] Inventors: Hiroshi Kanno; Toshio Endo, both of Shiroishi; Keiichi Miyakawa; Masao Takano, both of Miyagi, all of Japan

[73] Assignee: Ricoh Co., Ltd., Tokyo, Japan

[21] Appl. No.: 91,781

[22] Filed: Sep. 1, 1987

[30] Foreign Application Priority Data

Sep. 9, 1986 [JP] Japan ..... 61-213497
Sep. 10, 1986 [JP] Japan ..... 61-213581

[51] Int. Cl.[4] ..... B41F 15/08; B41F 33/00; B41L 13/16

[52] U.S. Cl. ..... 101/118; 101/129; 101/233

[58] Field of Search ..... 101/216, 232, 217, 233, 101/234, 116, 118, 119, 136–140, 141–145

[56] References Cited

U.S. PATENT DOCUMENTS 4,324,180 4/1982 Jiruse et al. ..... 101/216
4,353,299 10/1982 Murai et al. ..... 101/232 X

*Primary Examiner*—J. Reed Fisher
*Attorney, Agent, or Firm*—Oblon, Fisher, Spivak, McClelland & Maier

[57] ABSTRACT

A speed control method for printing press wherein a predetermined reference value of rotation speed of a plate cylinder is set in a controller, and when a rotation speed which differs from the reference value to exceed it is set in the controller, the plate cylinder is started to rotate at a speed lower than the reference value and the rotation speed of the plate cylinder is then increased stepwise at the rate of printing integer sheets of printing paper until it reaches the set rotation speed.

5 Claims, 7 Drawing Sheets

SPEED CONTROL METHOD FOR PRINTING PRESS AND PRINTING PRESS PRACTICING THE METHOD

BACKGROUND OF THE INVENTION

1. Field of the Invention

This invention relates to a speed control method for printing press and a printing press practicing the method.

2. Description of the Prior Art

Generally, in a printing press, for example, a rotary mimeograph printing press, the printing speed, that is the rotation speed of a drum or plate cylinder can be set desirably by the operator when printing. Printing is started when the rotation speed of the drum reaches a set value or during a period of time in which the rotation speed of the drum changes increasingly before it reaches the set value.

However, in case where printing is started with the rotation speed of the drum reaching the set value, the time required for overall printing is disadvantageously prolonged, and where printing is started while the rotation speed of the drum is changing, there arises a problem that a sheet of printing paper is printed at different printing speeds because the rotation speed changes continuously, in particular, linearly throughout a period covering the initial rotation and the attainment of the set value, thus causing non-uniform density of picture in which a picture is more shaded at a portion printed at a low printing speed than at a portion printed at a high printing speed.

Another method has been available wherein the drum or plate cylinder is initially rotated at a speed set by the operator. In this case, when the set speed is high, a drive system is abruptly loaded and through repetitious operations, the drive system is degraded to lose durability and damaged in an extremity.

It is also desired in printing that when some abnormality (for example, mechanical lock) occurs in a load system on the printing press and the load increases abruptly, a drive motor be stopped quickly. Conventionally, an emergency stop device for the drive motor has been available which uses a fuse or a breaker that makes use of an increase in current attendant on an increased load to disconnect an electrical circuit. However, the fuse or breaker is dedicated to protecting the drive motor from overheating and consequent burning-out and is operated, in principle, with heat generated by an overcurrent. Accordingly, the emergency stop device delays in responding and has irregularity in operation time, failing to meet the requirement of emergency stop.

With the conventional printing press, therefore, as the load increases, generated torque is increased correspondingly, with the result that the motor is forced to increase torque thereby imposing excessive torque on a drive transmission system and in extremities there occur troubles that a belt for drive transmission is tensed so vigorously as to be flown off and gears are torn off. Since such breaking of the belt and gears usually proceeds within one second at the least and matures in advance of the activation of the low-response fuse and breaker, it is impossible to avoid such breaking.

SUMMARY OF THE INVENTION

Accordingly, the present invention contemplates elimination of the above drawbacks of the conventional printing press and has for its object to provide a control method and a printing press practicing the control method which can reduce the time required for overall printing, can print a sheet of printing paper at a uniform speed without causing non-uniform density of picture and can prevent the drive system from being abruptly loaded.

According to the invention, to accomplish the above object, there is provided a speed control method for printing press wherein a predetermined reference value of rotation speed of a plate cylinder is provided, and when a rotation speed which differs from the reference value to exceed it is set, the plate cylinder is started to rotate at a speed lower than the reference value and the rotation speed of the plate cylinder is then increased stepwise at the rate of printing integer sheets of printing paper until it reaches the set rotation speed.

With this contruction of the present invention, when a higher rotation speed of the plate cylinder than the reference value is set by the operator, the plate cylinder is started to rotate at a lower speed than the set speed and the rotation speed of the plate cylinder is increased stepwise at the rate of printing integer sheets of printing paper until it reaches the set speed, whereby printing paper can be printed sheet by sheet at a unvarying speed until the rotation speed of the plate cylinder reaches the set speed, thereby ensuring that the occurrence of non-uniform density can be prevented and the abrupt application of an excessive load on the drive system can be prevented so that strength of parts constituting the drive system can be reduced to achieve reduction of the manufacture cost.

To accomplish the aforementioned object, according to the invention, there is also provided a printing press comprising a controller for controlling a plate cylinder drive motor, and a sensor for delivering a signal to the controller each time the plate cylinder makes a revolution, the controller being set with a predetermined reference rotation speed and a desired rotation speed selected by the operator and receiving an actual rotation speed to effect controlling such that when the desired rotation speed is higher than the reference rotation speed, the plate cylinder is started to rotate at an actual rotation speed which is lower than the reference rotation speed and the actual rotation speed is then increased stepwise to a predetermined rotation speed each time the sensor is turned off.

Another object of this invention is to provide a printing press capable of obviating the defect of the conventional printing press that when the load is increased abruptly, the drive transmission system will be broken.

To accomplish this object, according to an embodiment of the invention, there is provided a printing press comprising means for generating a voltage proportional to a rotation speed of the drive motor, a voltage comparator for comparing the voltage with a reference voltage and producing an output signal when the voltage is lower than the reference voltage, and means responsive to the output signal from the voltage comparator to stop the drive motor.

Since in the embodiment constructed as above the rotation speed of the drive motor is detected which decreases as the load increases and the detected rotation speed is converted into the voltage which is compared with the reference voltage so as to be used for stopping the drive motor, the time lapse between occurrence of an abnormal load and the stopping of the drive motor can be minimized to considerably increase the response speed. Consequently, before torque generated by the drive motor exceeds a permissible level of torque of the drive transmission system, the drive motor can be stopped and so damage of the drive transmission system due to flying-off of the belt and tearing-off of the gears can be obviated.

DESCRIPTION OF THE PREFERRED EMBODIMENTS

The invention will now be described by way of example with reference to the accompanying drawings.

Figure 1:
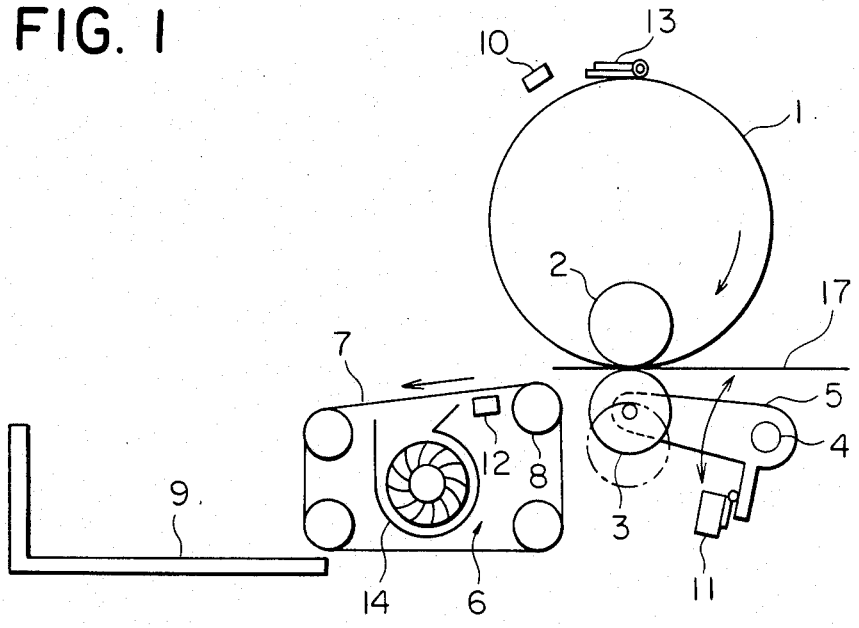
FIG 1 is a schematic front view illustrating a printing press according to an embodiment of the invention.
Figure 2:
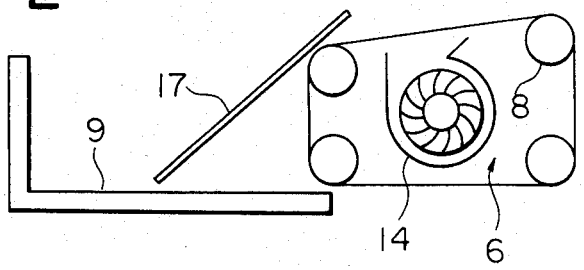
FIG. 2 is an enlarged front view illustrating paper discharge/transport means used in the printing press of FIG. 1.

Referring now to FIG. 1, there is illustrated a rotary mimeograph printing press according to an embodiment of the invention. The printing press comprises a drum or plate cylinder 1 being rotatable about a center axis of its own and having the outer circumferential surface around which a stencil printing master is wound with its tip clipped by a clamp 13, and an ink supply roller 2 provided interiorly of the plate cylinder 1 so as to supply ink to an inner wall of plate cylinder 1 which is of a porous structure. A press roller 3 beneath the plate cylinder 1 is supported by a support arm 5 at a position at which the press roller 3 opposes the ink supply roller 2. The press roller 3 is swingable about an axis 4 in synchronism with rotation of the plate cylinder 1 by means of a drive motor, not shown. The press roller 3 is operative to push a printing paper sheet 17 fed from a paper feed means, not shown, against the outer circumferential surface of the plate cylinder 1 and causes ink, permeating through perforations in the stencil printing master wound around the outer circumferential surface of the plate cylinder 1, to be transferred to the printing paper sheet, thus forming a picture.

A paper discharge/transport means 6 is comprised of several endless belts 7 applied on four rollers 8 and an air suction box 14 provided interiorly of the belts and operative to transport the printing paper sheet 17 formed with the picture to a paper discharge stand 9. In this embodiment, the four rollers 8 are driven for rotation by the same drive motor as that for the plate cylinder 1, so that the endless belts 7 may be moved in a direction indicated by arrow in FIG. 1 to transport in the arrow direction the printing paper sheet 17 pulled against the endless belts 7 by attraction force created by the air suction box 14.

A drum or plate cylinder position detecting sensor 10 detects a predetermined rotational position of the plate cylinder 1. A printing pressure detecting sensor 11 is adapted to detect the state of the press roller 3 and particularly it detects that the press roller 3 is pushed against the plate cylinder 1. A paper rear end detecting sensor 12 detects that the rear end of a printing paper sheet 17 conveyed on the endless belts goes past the sensor 12.

Figure 3:
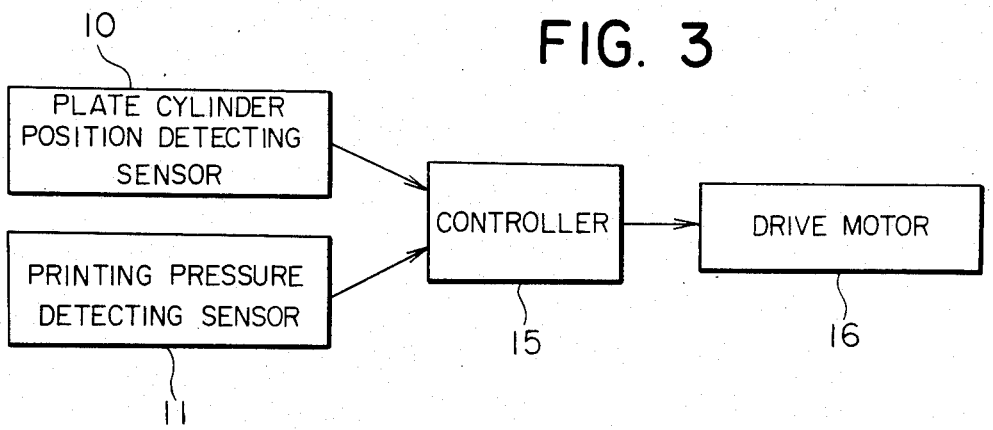
FIG. 3 is a block diagram showing plate cylinder speed control means used in the printing press of FIG. 1.
Figure 4:
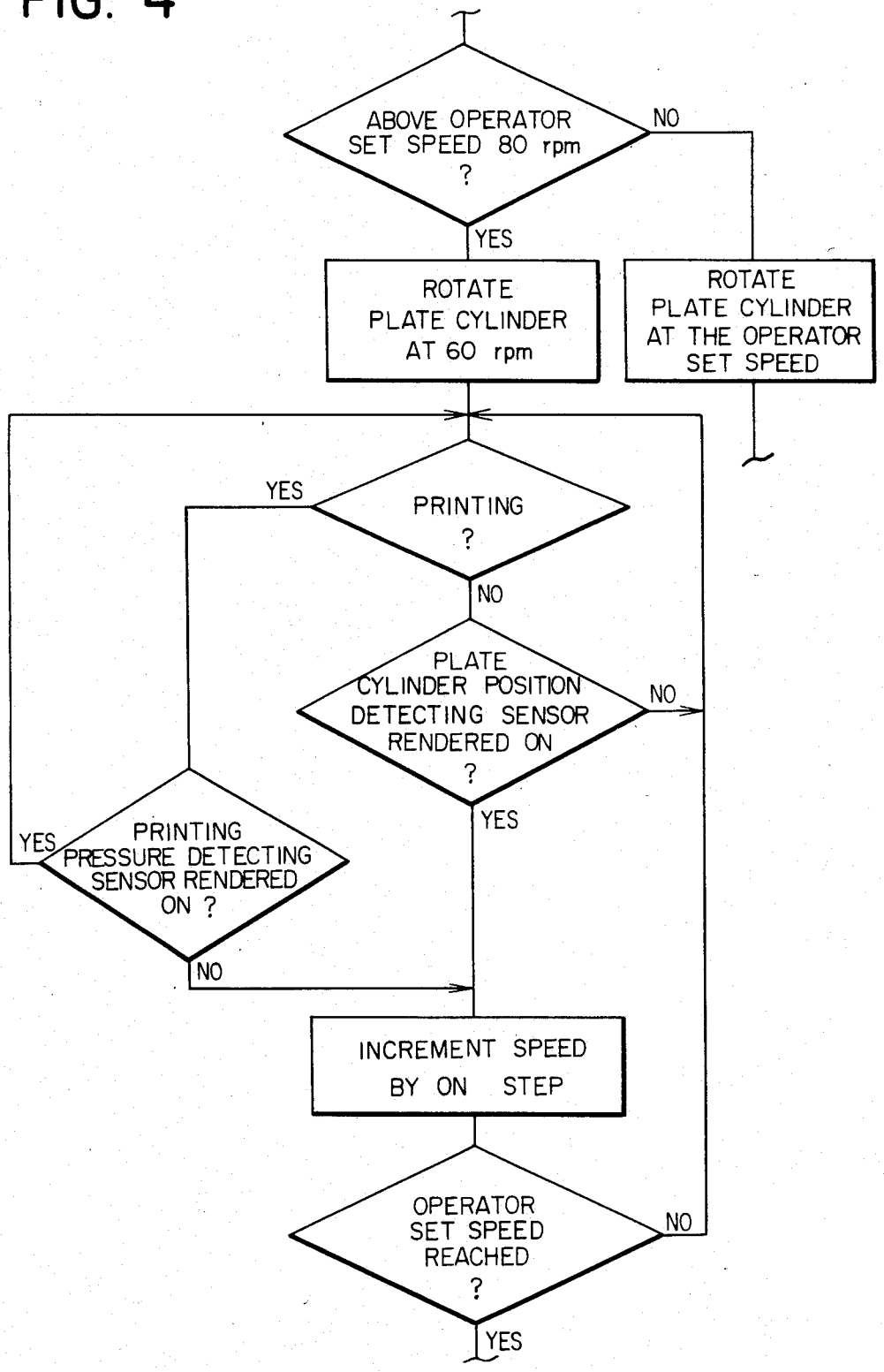
FIG. 4 is a flow chart illustrative of the operation of the FIG. 1 printing press.
Figure 5:
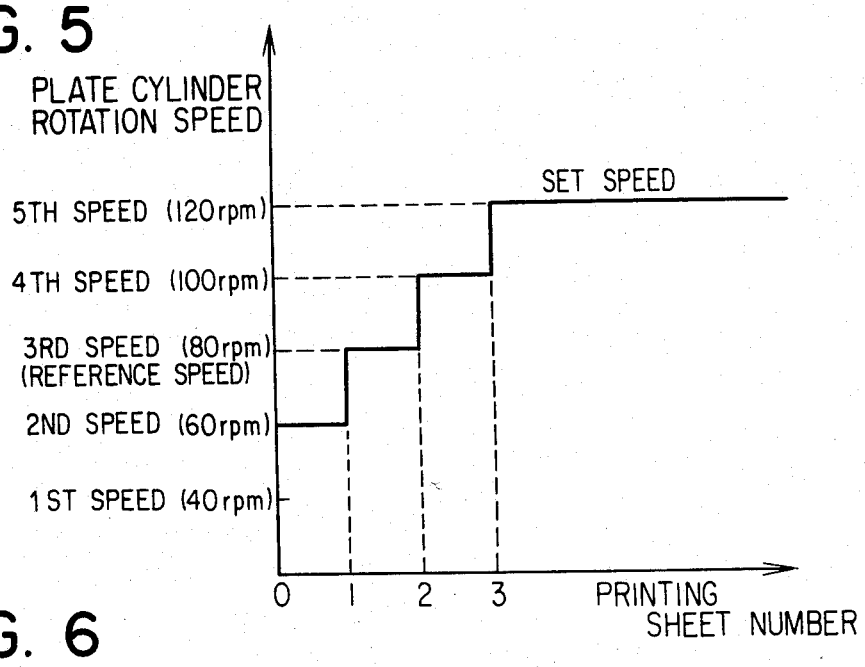
FIG. 5 is a graph showing an example of changes in speed of the plate cylinder as effected in the flow chart of FIG. 4.

FIG. 3 illustrates, in block form, a speed control system, FIG. 4 shows a flow chart illustrative of the operation of the speed control system and FIG. 5 shows an example of changes in speed. By making reference to these figures, a speed control method will now be described.

When the operator sets a rotation speed of the plate cylinder 1 by means of a speed setting key provided on an operation panel, not shown, to operate the printing press in order to obtain a printed paper sheet, a controller 15 compares a reference speed previously set in the controller with the rotation speed set by the operator and sends a command for rotation of the plate cylinder 1 to the drive motor designated by reference numeral 16 in FIG. 3, and the plate cylinder 1 is started to rotate.

When the rotation speed set by the operator is lower than the reference speed, the plate cylinder 1 is started to rotate at the speed set by the operator. However, when the operator sets a rotation speed, for example, a fifth speed (120 rpm) which is higher than the reference speed (in the example of FIG. 5, a third speed measuring 80 rpm), the plate cylinder 1 is started to rotate at an initial second speed (60 rpm) which is lower than the reference speed. Alternatively, the plate cylinder 1 may be started to rotate at a first speed (40 rpm) or at the third speed which is the reference speed.

When the plate cylinder 1 starts to rotate, a printing paper sheet 17 passes through a gap between plate cylinder 1 and press roller 3, the press roller 3 is pushed against the plate cylinder 1 by means of a cam, not shown, to perform printing, and the printing paper sheet 17 is then transported to the paper discharge stand 9 by means of the paper discharge/transport means 6. With the press roller 3 pushed against the plate cylinder 1, the support arm 5 of the press roller 3 is turned clockwise to thereby turn on the printing pressure detecting sensor 11. As the plate cylinder 1 continues rotating, the press roller 3 is lowered and the support arm 5 is turned counterclockwise to thereby turn off the printing pressure detecting sensor 11. A signal indicative of turn-off of the printing pressure detecting sensor 11 is applied to the controller 15 which in turn sends to the drive motor 16 a command signal by which the rotation speed of the plate cylinder 1 as changed from the second speed to the third speed. The rotation speed of the plate cylinder 1 is changed in this manner each time the plate cylinder 1 makes a revolution, that is, a sheet of paper is printed, so as to be increased stepwise until it reaches the speed set by the operator. In an alternative, the speed change may be effected each time the plate cylinder 1 makes plural revolutions, that is, a plurality of sheets of paper are printed.

In case where the printing press has been left unused for a long period of time and thereafter it is used again, an idling operation is effected wherein ink to be supplied to the plate cylinder 1 is kneaded and then supplied to the plate cylinder 1. During the idling operation, no printing paper sheet is fed and consequently the printing pressure sensor 11 is not on/off operated and the controller 15 receives no signal from the sensor 11. Accordingly, in this case, a pulse signal produced from the plate cylinder position detecting sensor 10 each time the plate cylinder 1 makes a revolution may be applied to the controller 15 to control the rotation speed of the plate cylinder 1 in the same manner as described previously.

Incidentally, in order to steadily bring a stencil printing master into intimate contact with the outer circumferential surface of the plate cylinder 1 and to steadily transfer ink from the plate cylinder to a printing paper sheet, a process termed an imposing operation is usually carried out prior to the printing process. The imposing operation is effected by advancing a printing paper sheet 17 at a far lower speed (for example, in terms of a plate cylinder rotation speed of 10 rpm) than the usual printing speed while the printing paper sheet is applied with the printing pressure by means of the press roller 3. In the imposing operation, as well known in the art, the lower the paper transport speed, the more the stencil printing master is brought into intimate contact with the plate cylinder 1 and rising of a picture in the subsequent printing process can be improved.

The imposed printing paper sheet is conveyed by the paper discharge/transport means 6 to the paper discharge stand 9 as in the case of printing process. Since in this embodiment the four rollers 8 of the paper discharge/transport means 6 are driven by the same drive source as that for the plate cylinder 1 and so rotated at a lower speed than that for printing, the imposed printing paper sheet carried on the endless belts 7 is conveyed at a low speed, resulting in a disadvantage that especially with a relatively thick paper sheet, the paper sheet is stopped before it is perfectly discharged onto the paper discharge stand 9. If under this condition the operation proceeds to the subsequent printing process, then the imposed paper sheet will hinder paper transport and sheets of paper subsequently discharged will be jammed.

Accordingly, with the aim of steadily discharging onto the paper discharge stand the paper sheet which has been conveyed at the very low speed for imposing operation, the transport speed of the endless belts 7 of the paper discharge/transport means 6 is changed on the way in this embodiment.

For steady imposing operation, it is desired that a printing paper sheet be advanced at a very low speed while the press roller 3 is pushed against the outer circumferential surface of the plate cylinder 1. Therefore, it is conceivable that an instant that the press roller 3 disengages from the outer circumferential surface of the plate cylinder 1 is detected by the printing pressure sensor 11 and beginning with this instant, the drive speed of the transport means 6 is increased. With this construction, as soon as a printing paper sheet, especially, of a relatively large size (for example, B4 size) has been released from the press roller 3, the paper discharge speed for the printing paper sheet 17 can be increased, thereby ensuring that even an imposed paper sheet can steadily be discharged onto the paper discharge stand 9. However, in the case of a printing paper sheet of a relatively small size, at an instant the press roller 3 disengages from the plate cylinder 1, an imposed printing paper sheet has already passed through the transport means 6 or reached the end portion of the transport means 6 and consequently the increase in the paper discharge/transport speed according to the above construction will be done in vain.

To eliminate the above inconvenience in accordance with this embodiment, at an instant the paper rear end detecting sensor 12 detects the rear end of an imposed paper sheet 17, the paper discharge/transport speed of the transport means 6 is increased (for example, to 30 to 40 rpm in terms of the plate cylinder rotation speed) to thereby permit even a small-size imposed paper sheet to be discharged steadily onto the paper discharge stand 9.

Figure 6:
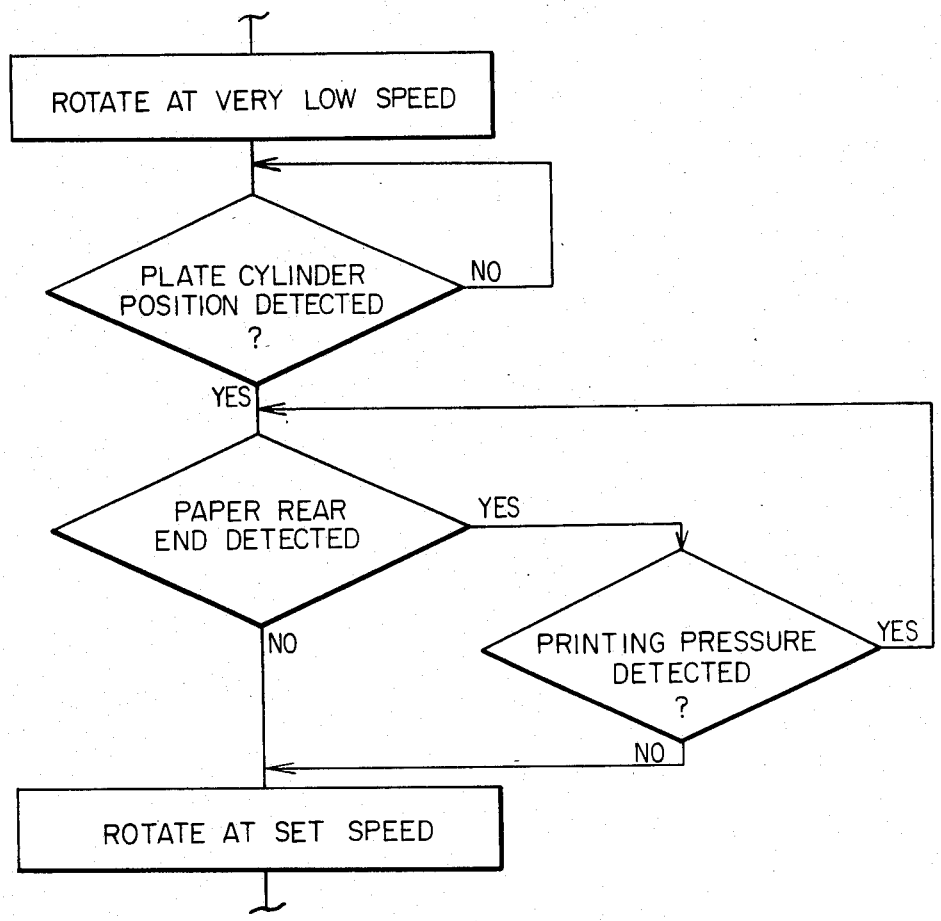
FIG. 6 is a flow chart illustrative of speed control by the paper discharge/transport means used in the printing press of FIG. 1.

This controlling is carried out in accordance with a flow chart as shown in FIG. 6. When the plate cylinder 1 goes past the plate cylinder position detecting sensor 10, the front end of a printing paper sheet has already passed through the paper rear end detecting sensor 12 and the presence of the printing paper sheet can be decided. Subsequently, as soon as the paper rear end detecting sensor 12 has detected the rear end of the paper sheet, the drive speed of the transport means 6 is changed to a high value. If the size of a printing paper sheet is particularly large (for example, amounting to A3 size), the press roller 3 will disengage from the plate cylinder 1 before the paper rear end detecting sensor 12 detects the rear end of the paper sheet. Therefore, in such an instance, as soon as the printing pressure detecting sensor 11 has detected the disengagement of the press roller 3 from the plate cylinder 1, the drive speed of the transport means 6 is changed to a high value.

Figure 7:
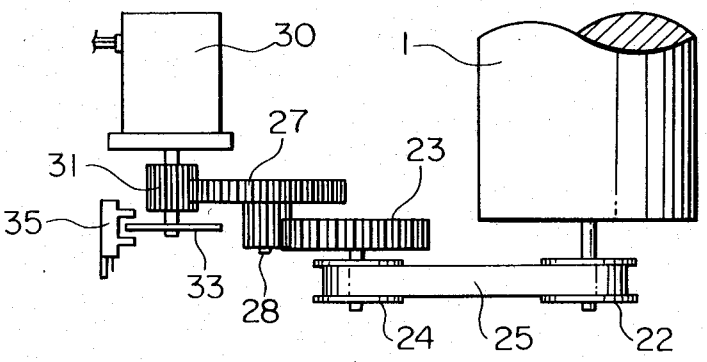
FIG. 7 is a plan view showing the essential part of a printing, press according to another embodiment of the invention.

FIG. 7 illustrates the essential part of a printing press according to another embodiment of the invention in which a plate cylinder 1 has its rotary shaft mounted with a pulley 22. A drive transmission belt 25 is applied on the pulley 22 and a pulley 24 which is integral with a gear 23 on the same shaft. The gear 23 meshes with a pinion 28 which is integral with a gear 27 on the same shaft and the gear 27 meshes with a pinion 31 mounted on the rotary shaft of a drive motor 30.

Figure 8:
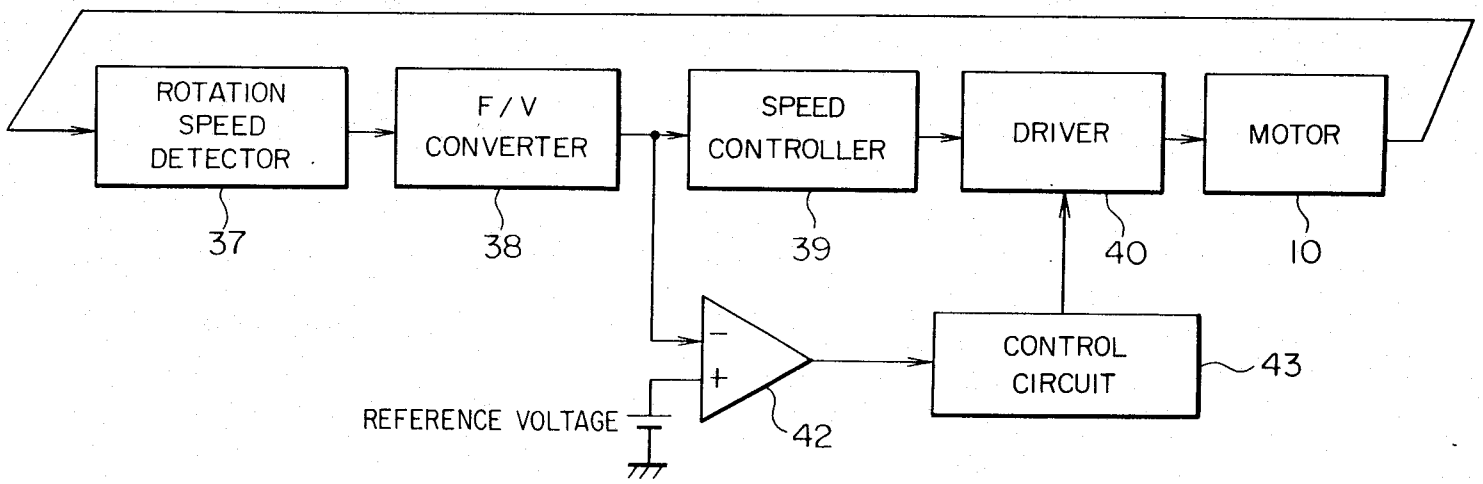
FIG. 8 is a block diagram showing a control system applicable to the printing press shown in FIG. 7.
Figure 9:
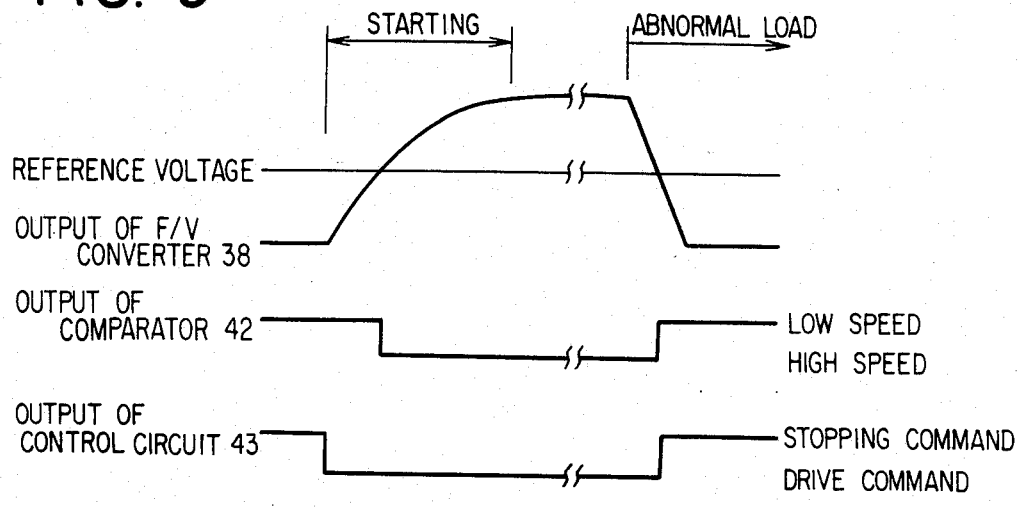
FIG. 9 is a timing chart illustrative of principal operations in the FIG. 8 control system.

The rotary shaft of the motor 30 carries a slit disc 33 having the outer circumferential edge formed with a slit. In the vicinity of the outer circumferential edge of the slit disc 33, a photo-interrupter 35 is arranged having an optical path which is closed through the slit in the disc 33 and the photo-interrupter detects a rotation speed of the motor 30 in accordance with a frequency at which the optical path is closed. The photo-interrupter 35 and slit disc 33 constitute a rotation speed detector 37 as illustrated in FIG. 8. The rotation speed detector 37 produces a rectangular waveform signal at a frequency which depends on a rotation speed of the motor 30.

FIG. 8 illustrates a control system applicable to the printing press of FIG. 7.

Referring to FIG. 8, a frequency/voltage (F/V) converter 38 receives the signal delivered out of the rotation speed detector 37 to convert it into a voltage signal proportional to the frequency, and a speed controller 39 responds to the voltage signal indicative of the rotation speed to produce a drive signal which corrects a difference between the rotation speed and a set speed. A driver 40 receives the drive signal from the speed controller 39 and drives the motor 30. A comparator 42 compares the voltage signal from the F/V converter 38 with a reference voltage and when the former is lower than the latter, the comparator 42 sends a signal to a control circuit 43 which in turn sends to the driver 40 a command for stopping the motor 30.

With this construction, when no abnormal load is applied on the printing press and this press operates under normal condition, torque of the motor 30 is transmitted to the plate cylinder 1 through a reduction gear mechanism comprised of the gears 23 and 27, pinions 28 and 31, and transmission belt 25 to thereby rotate the plate cylinder 1 at a predetermined speed. With the plate cylinder 1 rotating at the predetermined speed, the voltage converted from the rotation speed at the F/V converter 38 does not fall below the reference voltage and as a result, no signal is supplied from the comparator 42 to the control circuit 43.

Contrarily, when abnormality occurs in the load system of the printing press and a load on the printing press is abruptly increased, the rotation number of the motor 30 decreases with the result that the rotation speed detected by the rotation speed detector 37 and converted by the F/V converter 38 into the voltage fall below the reference voltage. Consequently, the comparator 42 delivers the signal to the control circuit 43 which in turn sends to the driver 40 the command for stopping the motor 30, and the motor 30 stops.

At the initial phase of starting, the motor 30 is rotated at a speed which is lower than the set speed and the voltage sent from the F/V converter 38 to the comparator 42 does not reach the reference voltage. But, in this case, the control circuit 43 exceptionally takes care of the signal received from the comparator 42 and does not issue the drive stopping signal to the driver 40.

In the present embodiment, the rotation speed is converted into the voltage by using the F/V converter 38 for illustration purpose only but the conversion may be achieved by means of another device using a magnet and a coil in combination such as a tachometer.

Figure 10:
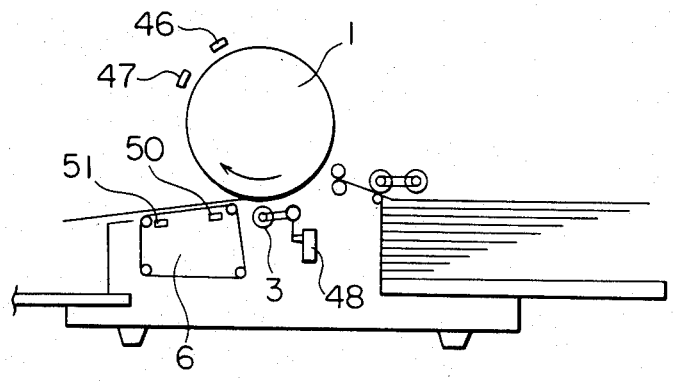
FIG. 10 is a front view showing a mechanism for detecting a paper feed jam and a paper discharge jam in the printing press having the essential part shown in FIG. 7.
Figure 11:
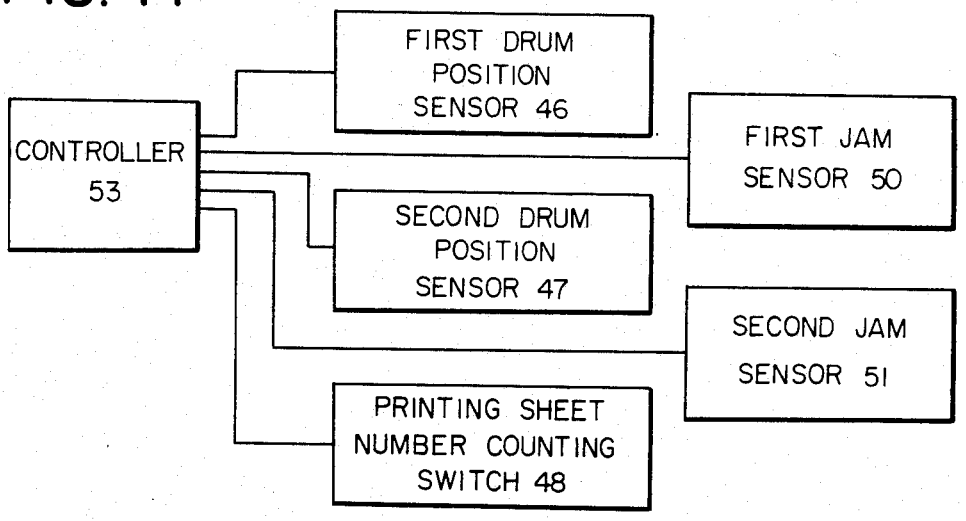
FIG. 11 is a block diagram showing a control system of the FIG. 10 detection mechanism.

The printing press also comprises a detection means for detecting feed paper jam and discharge paper jam, as shown in FIGS. 10 and 11. Referring to FIG. 10, first and second drum position sensors 46 and 47 are arrange in the vicinity of the outer circumferential surface of the drum 1, a printing sheet number counting switch 48 is arranged near the press roller 3, and first and second jam sensors 50 and 51 are provided in the paper discharge/transport means 6. As shown in FIG. 11, these sensors 46, 47, 50 and 51 and the switch 48 are connected to a controller 53.

Figure 12:
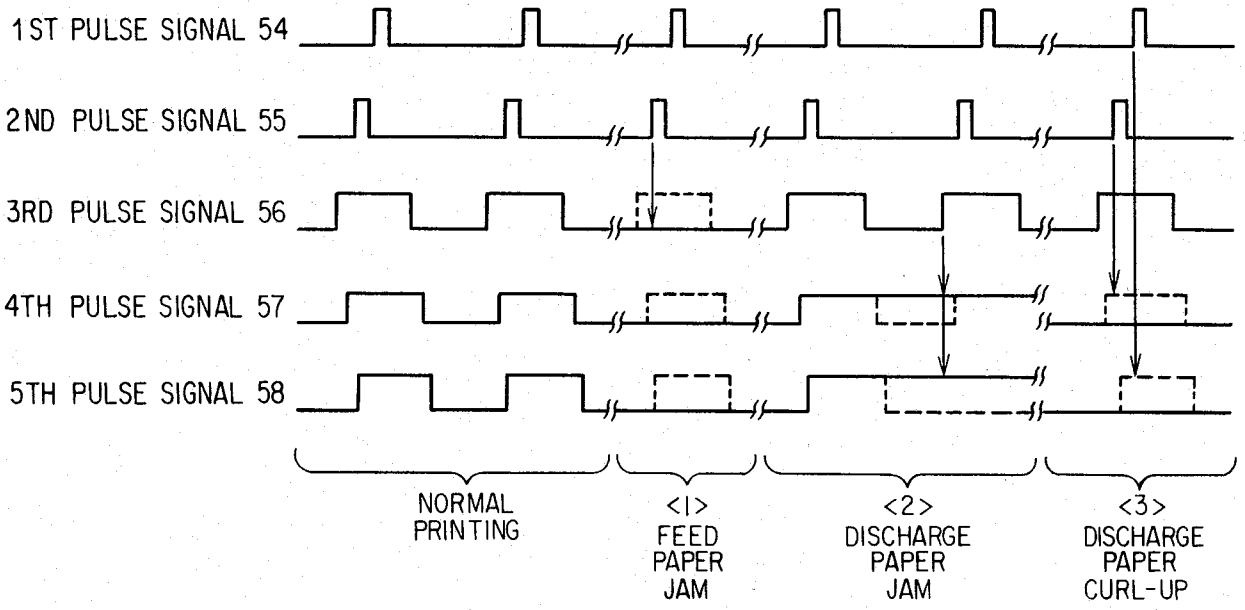
FIG. 12 is a timing chart illustrative of the operation of the FIG. 11 control system.

With the above construction, during printing, first and second pulse signals 54 and 55 as indicated in FIG. 12 are generated by the first and second drum position sensors 46 and 47, respectively, each time the drum 1 makes a revolution. By using the generated pulse signals 54 and 55 as timing pulses, the controller 53 decides a third pulse signal 56 generated by the printing sheet number counting switch 48 and fourth and fifth pulse signals 57 and 58 generated by the first and second jam sensors 50 and 51 so as to detect feed paper jam and discharge paper jam.

In the event that each type of jam is generated, it is detected as will be described with reference to FIG. 12.

<1 >Feed paper jam

Pulses of the third pulse signal 56 are generated from the printing sheet number counting switch 48 in synchronism with pulses of the second pulse signal 55 generated from the second drum position sensor 47. The controller 53 fetches each pulse of the third pulse signal 56 and it decides and detects feed paper jam when a fetched pulse is low and normal paper feed when high.

<2> Discharge paper jam

When no feed paper jam occurs and paper feeding is effected, the printing sheet number counting switch 48 is turned on. In synchronism with pulses of the third pulse signal 56 generated from the switch 48, pulses of each of the fourth and fifth pulse signals 57 and 58 are generated from the first and second jam sensors 50 and 51. The controller 53 fetches each pulse of each of the fourth and fifth pulse signals 57 and 58 and it decides and detects discharge paper jam when a fetched pulse is high and normal paper discharge when low.

<3> Discharge paper curl-up

When no feed paper jam occurs and paper feeding is effected, a printing paper sheet goes past the jam sensors 50 and 51 and as a result, the fourth and fifth pulse signals 57 and 58 are generated by the jam sensors 50 and 51. The controller 53 fetches pulses of each of the fourth and fifth pulse signals. In particular, the controller 53 fetches pulses of the fourth pulse signal 57 generated from the first jam sensor 50 in synchronism with pulses of the second pulse signal 55 generated from the second drum position sensor 47 as well as pulses of the fifth pulse signal 58 generated from the second jam sensor 51 in synchronism with pulses of the first pulse signal 54 generated from the first drum position sensor 46. The controller 53 then decides and detects discharge paper curl-up when fetched pulses are both low and normal paper discharge when high.

In the manner described as above, feed paper jam and discharge paper jam can be detected using a minimal number of sensors and the switch and detection performance is not inferior to that obtained using a great number of exclusive sensors in the conventional press.

Figure 13A:
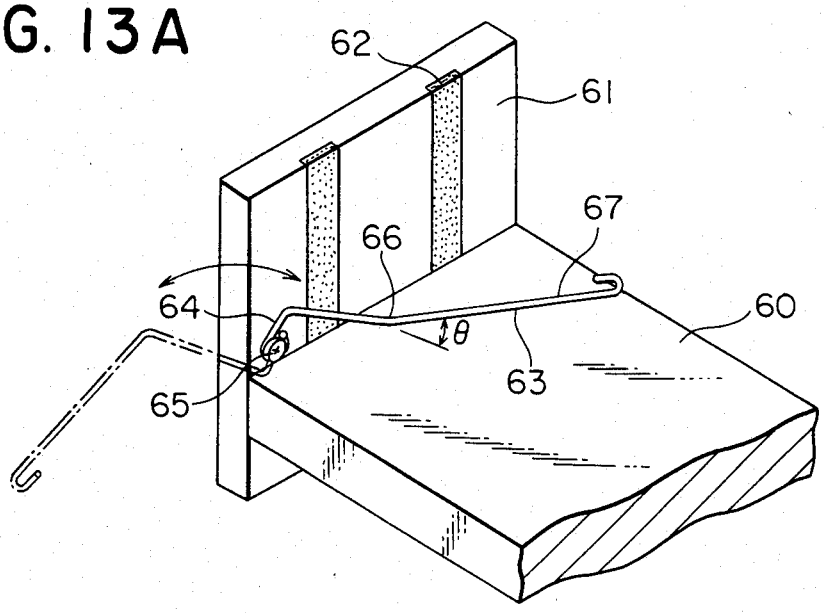
FIG. 13A is a perspective view illustrating a paper discharge stand used in the FIG. 10 detection mechanism.
Figure 13B:
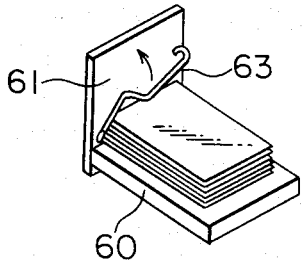
FIG. 13B is a perspective view showing an operational state of the FIG. 13A paper discharge stand.
Figure 14A:
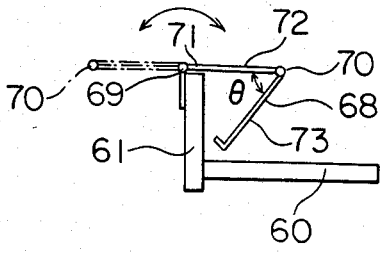
FIG. 14A is a front view illustrating a partial modification of the FIG. 13A paper discharge stand.

The printing press further comprises a paper discharge device as exemplified in FIGS. 13A or 14A. Referring to FIG. 13A, a paper discharge stand 60 is connected with an end plate 61 to which cushion members 62 are secured. Pivotally mounted on one side of the end plate 61 is a discharge paper push rod 63. The push rod 63 is pivoted at its base 64 by means of a setter 65 and is rotatable along a surface of the end plate 61 between a position on paper discharge stand 60 at which the push rod 63 is illustrated in solid line and a position outside paper discharge stand 60 at which the push rod 63 is illustrated in chained line. The push rod 63 has a head portion 67 which is bent upwards to make an angle $\theta$ to a bent portion 66 being in contact with the top surface of the paper discharge stand 60 in the absence of discharged paper sheet. The head portion 67 is operative to guide the front end of a discharged printing paper sheet. In this paper discharge device, as a sheet of printing paper is stacked on another on the paper discharge stand 60 each time the paper sheet is discharged, the push rod 63 is gradually deflected upwards as indicated by an arrow in FIG. 13B. When the discharged printing paper sheet is desired to be taken out of the paper discharge stand 60 or the paper discharge stand 60 is desired to be brought into and set in the printing press, the push rod 63 is turned to the chained line position so as not to interfere with the above operation, thus permitting the paper sheet to be taken out easily and the paper discharge stand to be set readily and improving efficiency of operation.

Figure 14B:
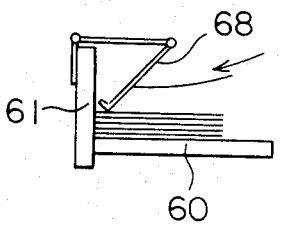
FIG. 14B is a front view showing an operational state of the FIG. 14A modification.

FIG. 14A shows a modified push rod. A push rod 68 has a base 71 which is pivotally mounted to the upper end of an end plate 61 by means of a setter 69 and is rotatable between a position above paper discharge stand 60 at which the push rod 68 is illustrated in solid line and a position outside paper discharge stand 60 at which the push rod is illustrated in chained line. The push rod 68 has a head portion comprised of an intermediate bar 72 which is substantially parallel with the paper discharge stand 60 in the absence of discharged paper sheet and a tip bar 73 which is supported by a setter 70 to make an angle $\theta$ to the intermediate bar 72. As shown in FIG. 14B, a sheet of discharged printing paper is guided at its front end by the tip bar 73 and stacked on another on the paper discharge stand 60. When the discharged printing paper sheet is desired to be taken out or the paper discharge stand 60 is desired to be set, the push rod 68 is turned to the chained line position.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A speed control method for a printing press having a rotating plate cylinder with a master clamped on the outer circumferential surface of said plate cylinder and a press roller spaced apart from the outer circumferential surface of said plate cylinder for pushing a printing paper sheet, which is fed from a paper feeding device, against the outer circumferential surface of said plate cylinder, comprising the steps of:

providing a predetermined reference value of rotation speed of said plate cylinder;

providing a selection means for setting a value for actual rotation speed operation of said plate cylinder;

comparing a selected actual rotation speed with said predetermined reference value and providing a first speed lowering output signal when the set value exceeds said predetermined reference value;

rotating said plate cylinder in response to said first speed lowering output signal at a speed at least as low as said predetermined reference value;

measuring the number of complete rotations of said plate cylinder and providing an output indicating the end of each of said rotations;

incrementing in an increased stepwise manner the rotation speed of said plate cylinder based upon said complete rotation indication; and stopping said increased incremented speed of said plate cylinder when the actual speed of rotation of said plate cylinder equals said set rotation speed.

2. A printing press, comprising:

a plate cylinder having clamped means for clamping a master on the outer circumferential surface of said plate cylinder;

a press roller, spaced apart from said outer circumferential surface of said plate cylinder so as not to interfere with said clamped means;

paper feed means for feeding a printing paper sheet wherein said press roller pushes said printing paper sheet fed from said paper feed means against said outer circumferential surface of said plate cylinder;

a plate cylinder drive motor for driving said plate cylinder;

a controller for controlling said plate cylinder drive motor;

a sensor for delivering a revolution completion signal to said controller each time said plate cylinder completes a revolution, wherein said controller includes a means for setting a predetermined reference rotation speed and a operator selected desired rotation speed;

means for measuring the actual rotation speed of said plate cylinder and feeding said measured signal to said controller wherein said controller further includes a comparison means for comparing said desired operator selected rotation speed with said predetermined reference value wherein said controller outputs a signal to said plate cylinder drive motor to begin rotation at an actual rotation speed which is at least as low as said reference rotation speed when said desired rotation speed is higher than said reference rotation speed and wherein said controller further includes a means for stepwise increasing said actual speed in response to said revolution completion signal from said sensor and said controller further including a means for stopping said stepwise increase when said actual rotation speed equals said operator selected desired rotation speed.

3. A printing press according to claim 2 wherein said sensor is a printing pressure sensor which delivers a signal each time said press roller disengages from the outer circumferential surface of said plate cylinder.

4. A printing press according to claim 2 wherein said sensor which delivers said revolution completion signal further comprises a sensor for detecting the rear end of a printing paper sheet to be discharged, and wherein said printing press further includes a paper discharge means and control means for increasing transport speed of said paper discharge means when receiving a paper rear end detection signal from said paper rear end detecting sensor.

5. A printing press according to claim 2 further comprising means for generating a voltage proportional to a rotation speed of said drive motor, a voltage comparator for comparing the voltage with a reference voltage and producing an output signal when said voltage is lower than said reference voltage, and means responsive to the output signal from said voltage comparator to stop said drive motor.

* * * * *